US012385364B2

(12) United States Patent
Mukherjee

(10) Patent No.: US 12,385,364 B2
(45) Date of Patent: Aug. 12, 2025

(54) METHODS AND SYSTEMS FOR HIGH RESOLUTION IMAGING AND RECONNAISSANCE OF BURIED SUBSURFACE INFRASTRUCUTRE USING ABOVE SURFACE GEOPHYSICAL SENSORS AND ARTIFICIAL INTELLIGENCE

(71) Applicant: Souvik Mukherjee, Katy, TX (US)

(72) Inventor: Souvik Mukherjee, Katy, TX (US)

( * ) Notice: Subject to any disclaimer, the term of this patent is extended or adjusted under 35 U.S.C. 154(b) by 0 days.

(21) Appl. No.: 18/106,351

(22) Filed: Feb. 6, 2023

(65) Prior Publication Data

US 2024/0263544 A1 Aug. 8, 2024

(51) Int. Cl.
*E21B 43/00* (2006.01)
*E21B 43/01* (2006.01)
*E21B 47/00* (2012.01)

(52) U.S. Cl.
CPC ..... *E21B 43/0122* (2013.01)

(58) Field of Classification Search
CPC ..... E21B 47/00; E21B 47/001; E21B 43/0122
See application file for complete search history.

(56) References Cited

U.S. PATENT DOCUMENTS

2019/0277135 A1* 9/2019 Zha ..... E21B 49/003
2021/0142515 A1* 5/2021 Luu ..... G06F 16/215

FOREIGN PATENT DOCUMENTS

GB 2602495 A * 7/2022 ..... E21B 47/00

* cited by examiner

*Primary Examiner* — Matthew R Buck
(74) *Attorney, Agent, or Firm* — John Douglas

(57) ABSTRACT

Described herein are methods and systems for the three-dimensional reconstruction of material properties of a target using remotely located physical sensors and deep learning artificial intelligence. The methods and systems include utilizing a one-dimensional vector as an input to a machine learning or artificial intelligence algorithm to construct a two-dimensional or three-dimensional image. The one-dimensional vector can be obtained by applying an adjoint operator to reproject data obtained from one or more remotely located physical sensors. The remotely located physical sensors can be located above ground and the target can be located below ground. The target can include a subsurface pipeline.

16 Claims, 6 Drawing Sheets

METHODS AND SYSTEMS FOR HIGH RESOLUTION IMAGING AND RECONNAISSANCE OF BURIED SUBSURFACE INFRASTRUCUTRE USING ABOVE SURFACE GEOPHYSICAL SENSORS AND ARTIFICIAL INTELLIGENCE

CROSS-REFERENCE TO RELATED APPLICATION

This application claims the benefit of and priority to U.S. Provisional Application No. 63/310,108, filed on Feb. 15, 2022, titled "EFFICIENT METHOD FOR HIGH RESOLUTION IMAGING AND RECONNAISSANCE OF BURIED SUBSURFACE PIPELINE AND OTHER INFRASTRUCTURE USING ABOVE SURFACE GEOPHYSICAL SENSORS AND ARTIFICIAL INTELLIGENCE", the entire disclosure of which is incorporated herein by reference.

FIELD OF THE INVENTION

The present disclosure relates to methods and systems for the three-dimensional reconstruction of material properties of a target using remotely located physical sensors.

BACKGROUND OF THE INVENTION

Three-dimensional image reconstruction using remote sensing sensors is a ubiquitous practice that cuts across many applications and industries ranging from the medical, oil and gas, mining, military, civil and environmental engineering, among others. These methods oftentimes use physics-based algorithms to simulate a response of the target material and its surroundings in the presence of an induced field of electromagnetic, gravitational, seismic, ultrasonic, or some other origin and uses data optimization algorithms to find the material properties that can simulate a response that most closely matches the response recorded by the receivers.

The number of receivers recording the response is usually far fewer than the number of elements required to successfully simulate the observed response, leading to an underdetermined system with a non-unique (more than one) material property distribution that could potentially simulate the response observed by the sensors. This requires the imposition of certain a priori constraints on the nature of distribution of the material properties that are used to "match" the observed sensor response. In many geologic situations of increasing commercial interest, such constraints often lead to poorly reconstructed images which may not represent the subsurface at reliable levels of accuracy and/or resolution.

A key benefit of introduction of machine learning approaches to such efforts is the removal of explicit mathematical constraints on the distribution of the target material properties. As used herein, the term "machine learning" refers to a subset of artificial intelligence involving algorithms and statistical models that enable computers to learn from data, identify patterns, and make predictions or decisions autonomously, without explicit programming, through techniques such as supervised learning, unsupervised learning, reinforcement learning, and deep learning. Machine learning methods aim to "train" the computer models to "learn" the response of various material property realizations of the subsurface and then determine the "best" distribution of material property given the input of the observed sensor response. It has been observed that where the deployment of machine learning algorithms is technically, logistically, and commercially feasible, there is a step change improvement in the resolution and accuracy of the reconstructed image/material properties.

The major bottlenecks to such methods are twofold: 1) the large volume of simulations that need to be generated to accurately represent a "universe" of potential candidates that may represent the subsurface material property distribution; and 2) The large memory consumption of the simulated models when being called for "training" by the machine learning algorithm. These constraints can limit the usage of machine learning algorithms for many problems of practical interest.

SUMMARY OF THE INVENTION

The present disclosure is generally related to methods and systems for the three-dimensional reconstruction of material properties of a target using remotely located physical sensors, and more particularly, to methods and systems of interrogating a subsurface target using remotely located physical sensors by obtaining, coverting, and processing data obtained from the sensors to obtain a multidimensional (3D and 4D) image reconstruction of the subsurface target.

According to some embodiments, a method of interrogating a subsurface target can include deploying one or more sensors and obtaining data from the one or more sensors. The method can also include converting the data from the one or more sensors to a one-dimensional vector via an adjoint operator. The method can further include processing the one-dimensional vector with a computer model to obtain a multidimensional (3D and 4D) image reconstruction of the target.

According to some embodiments, a method of interrogating a subsurface target can include deploying one or more sensors to a location above the Earth's surface, or in the case of interrogating subsea targets deploying one or more sensors to a location on or above the sea floor, and obtaining a plurality of data sets from the one or more sensors. The method can also include converting a first data set of the plurality of data sets to a first one-dimensional vector via an adjoint operator. The method can further include converting a second data set of the plurality of data sets to a second one-dimensional vector via an adjoint operator and converting a third data set of the plurality of data sets to a third one-dimensional vector via an adjoint operator. The method can further include processing the first, second, and third one-dimensional vectors with a computer model to obtain a multidimensional (3D and 4D) image reconstruction of the target.

According to some embodiments, a method of interrogating a subsurface pipeline can include deploying one or more sensors to a location above the Earth's surface, or in the case of interrogating subsea targets deploying one or more sensors to a location on or above the sea floor, and obtaining a plurality of data sets from the one or more sensors. The method can also include converting a first data set of the plurality of data sets to a first one-dimensional vector via an adjoint operator, converting a second data set of the plurality of data sets to a second one-dimensional vector via an adjoint operator, and converting a third data set of the plurality of data sets to a third one-dimensional vector via an adjoint operator. The method can further include processing the first, second, and third one-dimensional vectors with a computer model comprising machine learning algorithms for unstructured meshes to obtain a multidimensional (3D and 4D) image reconstruction of the pipeline. The computer model can be stored on a non-transitory memory configured to receive the data from the one or more sensors.

BRIEF DESCRIPTION OF THE DRAWINGS AND FIGURES

Figure 4:
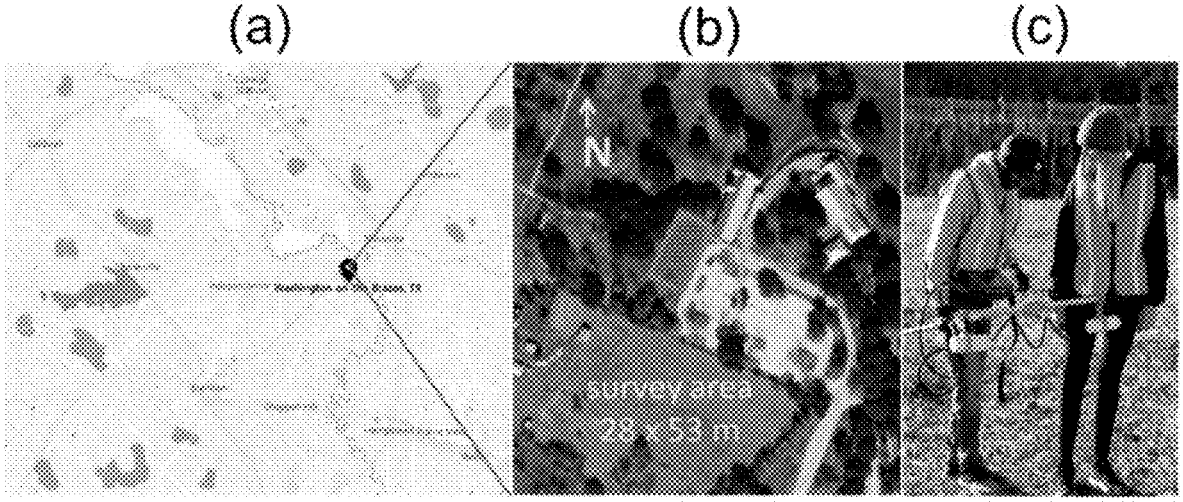

FIG. 4*a* depicts a Map showing survey location for the Washington-on-Brazos case study in Texas.

FIG. 4*b* depicts orientation and extent of surveyed area.

FIG. 4*c* depicts magnetometers used in the survey.

Figure 5:
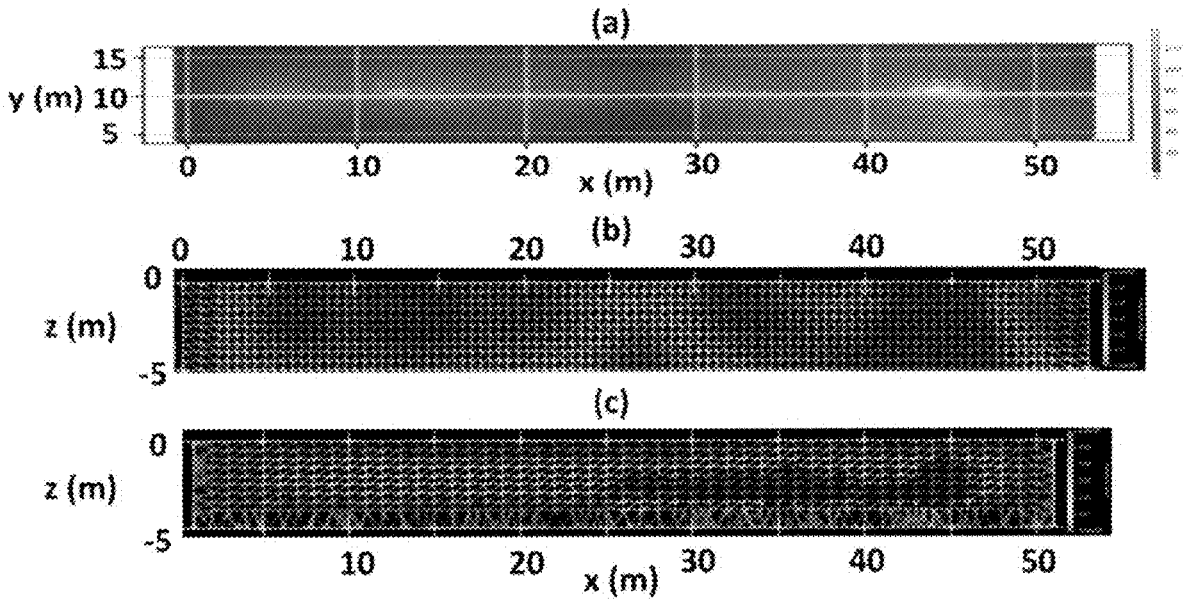

FIG. 5*a* depicts the vertical cross section right across the heart of the anomalies observed in the absolute amplitude map.

FIG. 5*b* depicts conventional least squares inversion results displayed in vertical cross section right across the heart of the 4 circular anomalies observed in FIG. 5*a*.

FIG. 5*c* depicts that the depth, and susceptibility distribution of the pipe is delineated and much more clearly visualized relative to conventional least squares inversion in FIG. 5*b*.

Figure 6:
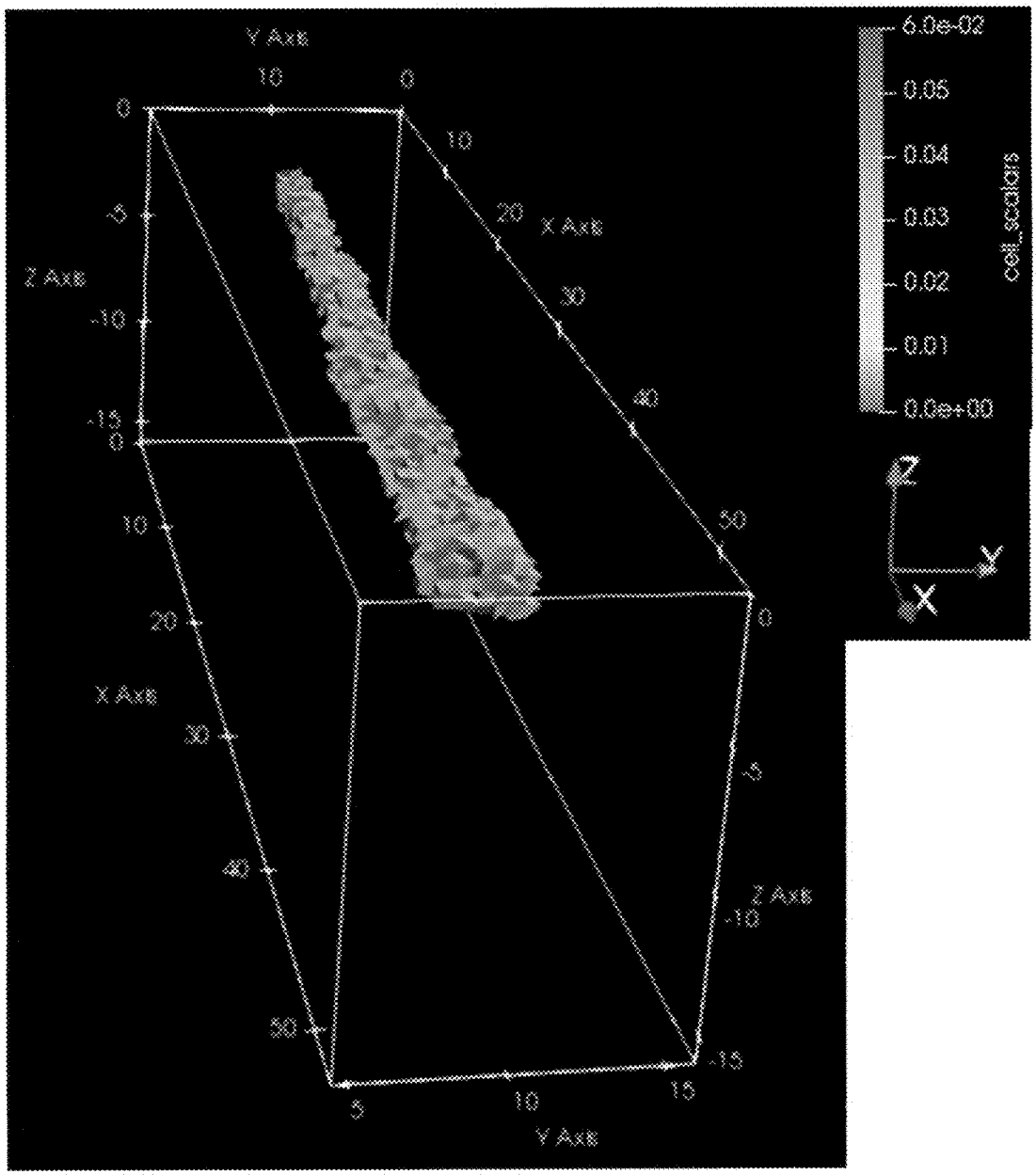

FIG. 6 depicts a threshold (0.01-0.06) value of normalized absolute susceptibility values from deep learning AI inversion, according to one or more embodiments.

DETAILED DESCRIPTION OF THE INVENTION

Most state-of-the-art deep learning machine learning architectures used to address image reconstruction issues follow a blueprint of dividing the image domain into several small pixels which are mathematically represented as two- or three-dimensional matrices. The input data is also cast into a matrix whose format is similar to that of the target image domain. A series of machine learning layers are introduced between the input data and the target or output image. Each of these layers include a set of smaller matrices which are then mathematically combined with a set of weights that help transform the values of the input data matrix to the output image matrix.

The two- and three-dimensional nature of the input and output matrix combined with the similar dimensions of the smaller matrices in the intermediate layers make this machine learning process memory intensive and is a key barrier for the solution of very large-scale imaging problems in a commercially effective manner.

Another, conventional method of image reconstruction does not deploy machine learning methods, but frequently stores its matrix as a one-dimensional vector and can map the input data to the dimensions of the output image by utilizing an adjoint operator. This transformation occurs at an intermediate step of a process that does not utilize artificial intelligence.

The present disclosure instead utilizes the data post adjoint transformation as the initial input for machine learning. By making this change, the computational footprint of the image reconstruction problem is dramatically reduced by one or two major dimensions. This reduction in computational footprint can translate into order of magnitude savings in computation time and cost without compromising the accuracy and resolution gains made with machine learning methods.

Additionally, the methods of the present disclosure simplify methods for designing machine learning algorithms for unstructured meshes, where the description of the images into clear cut divisions of U-, V-, and W-pixel units along each of the coordinate axes, x-, y-, and z-are not possible.

A general scheme for acquiring above ground geophysical sensor data can include using an airborne device, such as a drone. Such geophysical data can be collected by sensors disposed on multiple other means, including but not limited to helicopters, airplanes, ground borne vehicles, handheld devices, as also towed by boat, as a submarine device, for subsea pipelines amongst others.

The geophysical sensors can be any sensor suitable to illuminate the target using an active transmitter source such as one of acoustic, electromagnetic, or some other origin, while recording the response from the target in receivers placed in suitable locations. Alternatively, the receivers can record the target response in the presence of a passive source such as gravitational attraction and its gradients, the geomagnetic field, the magneto telluric field and others.

Utilizing the special technique disclosed here, the method can provide an order of magnitude improvement in computational speed and memory requirements over current state-of-the-art artificial intelligence-based systems. When compared against state-of-the-art methods that do not rely on artificial intelligence, the current method provides improvement in accuracy and resolution that enables high resolution imaging of buried infrastructure using above ground sensors mounted on drones and other devices possible. This level of improvement makes it feasible to perform several first order inspection tasks related to pipeline health, corrosion, integrity, and others that are currently only possible using inline inspection tools such as magnetic flux leakage (MFL) and ultrasonic (UT) sensors.

The collected sensor data is processed to remove the influence of above ground metallic infrastructure and the influence of the deeper subsurface geology. The residual field is trained various potential buried subsurface pipe location, geometry, and states of material property such as magnetic susceptibility, electrical conductivity, sonic/ultrasonic velocities, amongst others to determine optimal location, geometry, and effective material property distribution to infer pipeline health, integrity, and other issues.

Figure 1:
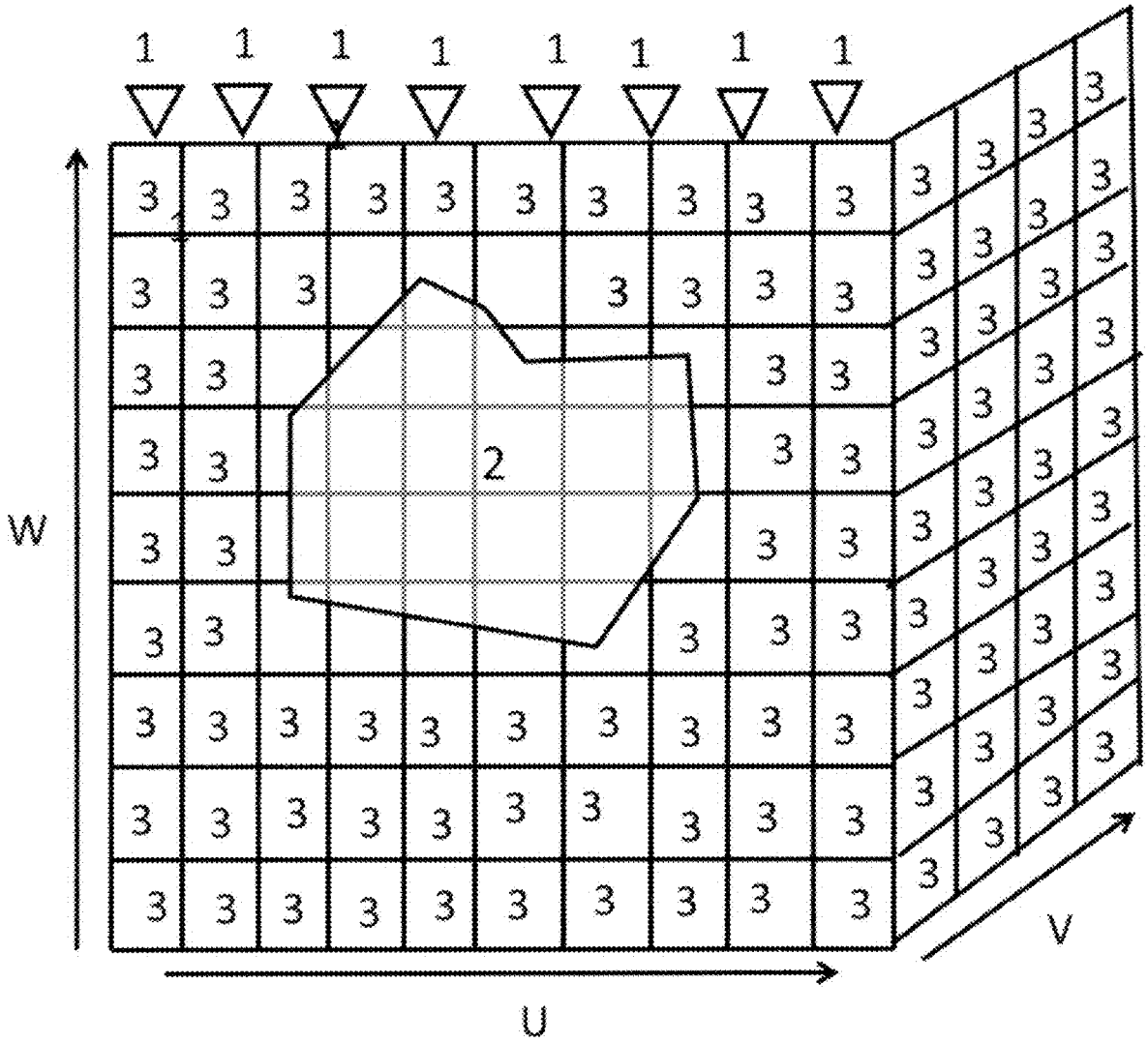
FIG. 1 depicts a schematic representation of image reconstruction from geophysical sensor data on an unstructured mesh, according to one or more embodiments.

FIG. 1 depicts a schematic representation of image reconstruction from geophysical sensor data on an unstructured mesh, according to one or more embodiments. The sensors 1 are located on or above the Earth's surface, or above the sea floor in the case of interrogating subsea targets. The subsurface is divided into arbitrarily shaped tetrahedral cells 2, 3. The first cells 3 contain material property values of the background while the second cells 2 contain the material property values of the anomalous target of interest.

Figure 2:
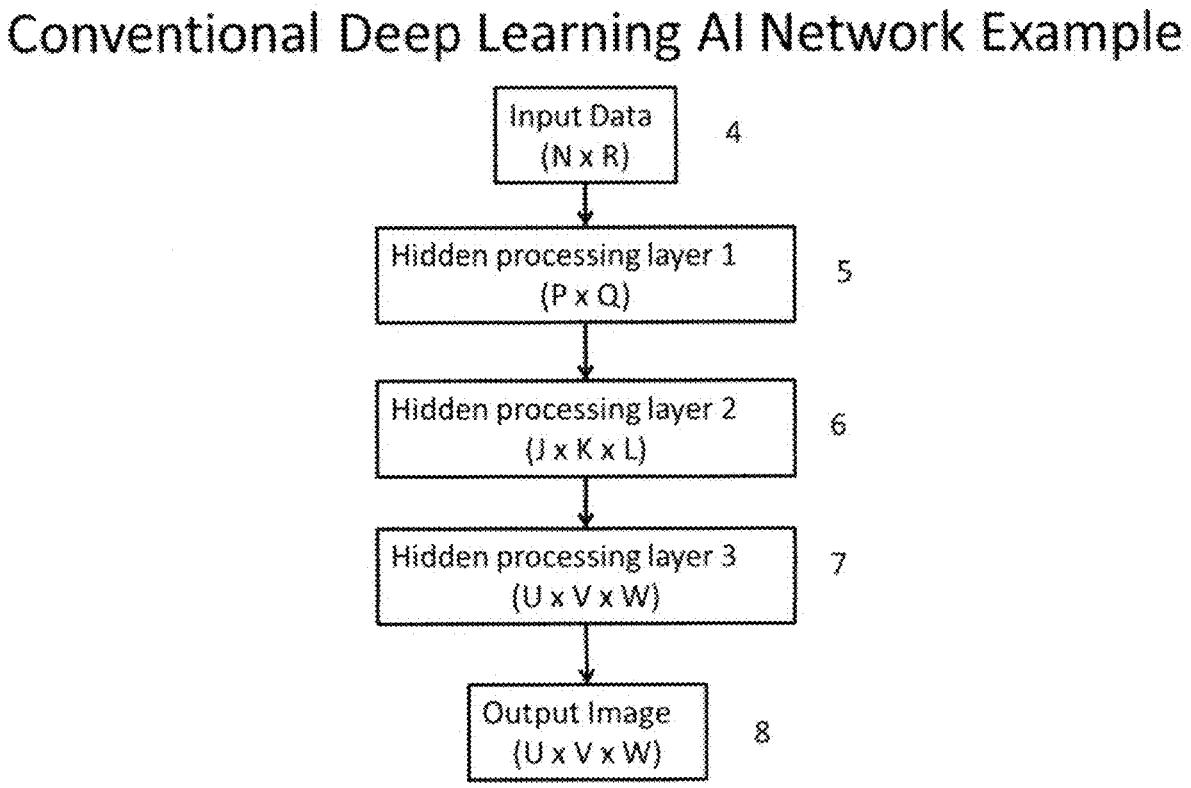
FIG. 2 depicts a schematic representation of a conventional deep machine learning architecture for reconstructing 2-D and 3-D images and/or material property inversion using remote sensors.

Referring to FIG. 2, a simple generic training architecture for current state-of-the-art deep multi-layer machine learning algorithm is shown for illustrative purposes. The input data, fed in the form of an N×R matrix, where N>1 and R>1, present in the first layer depicted as 5, is processed by a set of mathematical operators present in the first hidden layer, depicted as 6, and its output matrix whose shape is P×Q sent to the second hidden layer, depicted as 7, wherein the shape of the output matrix is transformed to J×K×L. Eventually, these transformations will result in an output matrix whose dimensions will be the same as the desired output image (U×V×W). Based on the differences between the pixel values of the output matrix and those images used as ground truth for training, the system will continue to iterate until the difference between the pixel values of the predicted image and the ground truth are below a certain predetermined threshold and/or subsequent iterations do not alter this difference much.

Figure 3:
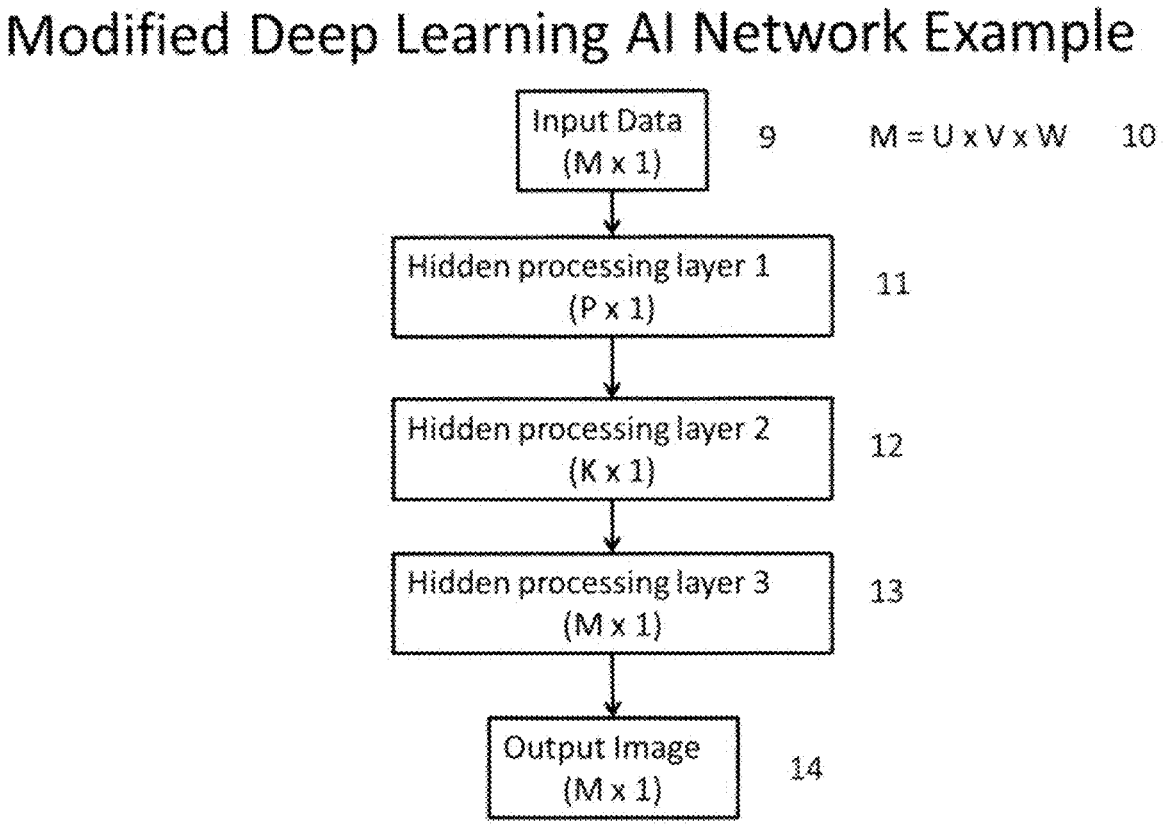
FIG. 3 depicts a schematic representation of deep machine learning architecture for reconstructing 3-D images and/or material property inversion using remote sensors using 1-D vector basis functions only, according to one or more embodiments.

In FIG. 3, the modification to this approach is discussed. The adjoint operator can be used to reproject the input data 10 to the same dimensions as the output image matrix 15 and recast as a vector, 11. Now, all the processing steps (12-15) are simplified as vector operations instead of matrices which reduce the overall computational footprint by about an order of magnitude. As used herein, the term "computational footprint" refers to the total impact of a computer model or simulation in terms of its consumption of computational resources, including processing power (e.g., CPUs, GPUs), memory (e.g., RAM), storage (e.g., non-transitory computer-readable medium such as hard drives or SSDs), energy consumption, scalability across distributed computing systems, and network usage, wherein these resources are managed and executed by computer hardware configured to perform specific tasks through executable instructions stored on non-transitory computer-readable media. While either approach is suitable for handling buried subsurface infrastructure like pipelines, the embodiment discussed in FIG. 3 is more efficient.

A practical demonstration of the method using data acquired by Texas A & M university students under the guidance of Prof. Mark Everett using handheld magnetic sensors is disclosed. FIG. 4*a* shows the location of Washington-on-Brazos State historic site where the data was acquired. FIG. 4*b* shows the dimensions of the field survey area and FIG. 4*c* shows the illustration of the magnetic sensor used for the data acquisition.

After suitable processing of data as discussed above, the results of inversion using conventional least squares method is shown in FIG. 5*b* and the corresponding values of relative susceptibility distribution using deep learning artificial intelligence is shown in FIG. 5*c*.

FIG. 6 depicts a threshold (0.01-0.06) value of normalized absolute susceptibility values from deep learning AI inversion, according to one or more embodiments.—Smoothing was applied for visual clarity. The reconstructed 3D image of the pipe like structure was enhanced using Al based inversion.

When applied to above ground magnetic sensor data, the method of the present disclosure was able to image the top of a pipe confidently at 1-1.5 meters below ground surface with variation in susceptibility along the pipe's axis suggestive of changes in thickness, corrosion, and other issues. The uncertainty in resolving the top of the structure was within 50 cm. In comparison, the conventional state-of-the-art least squares inversion algorithm was only able to provide an uncertainty bound of location of a pipe-like body somewhere between 0-3 m. This implies an uncertainty in resolution of the top of the structure of 3 m. This observation of the difference between the conventional methods and the method of the present disclosure suggests a conservative estimate of a 6-fold or more improvement in resolution of the pipe-like structure using artificial intelligence compared to conventional state-of-the-art least squares inversion.

The invention claimed is:

1. A method of interrogating a subsurface target, comprising:

deploying one or more sensors, wherein the one or more sensors are deployed above the surface of the Earth and the target is buried below the surface;

obtaining data from the one or more sensors, wherein the data is obtained from the one or more sensors via one or more airborne devices, each comprising a drone, a helicopter, or an airplane, one or more ground borne vehicles, or one or more handheld devices or any combination thereof;

converting the data from the one or more sensors to a one-dimensional vector via an adjoint operator;

processing the one-dimensional vector with a computer model to obtain a multidimensional (3D and 4D) image reconstruction of the target.

2. The method of claim 1, wherein the computer model includes machine learning algorithms for unstructured meshes.

3. The method of claim 1, wherein the target is a subsurface pipeline.

4. The method of claim 1, wherein the computer model is stored on a non-transitory memory that is configured to receive the data from the one or more sensors.

5. A method of interrogating a subsurface target, comprising:

deploying one or more sensors:

obtaining data from the one or more sensors;

converting the data from the one or more sensors to a one-dimensional vector via an adjoint operator;

processing the one-dimensional vector with a computer model to obtain a multidimensional (3D and 4D) image reconstruction of the target, wherein the resulting multidimensional (3D and 4D) image is suitable to identify pipeline intersections as well as unknown abandoned pipelines.

6. A method of interrogating a subsurface target, comprising:

deploying one or more sensors;

obtaining data from the one or more sensors;

converting the data from the one or more sensors to a one-dimensional vector via an adjoint operator;

processing the one-dimensional vector with a computer model to obtain a multidimensional (3D and 4D) image reconstruction of the target, wherein the resulting multidimensional (3D and 4D) image is suitable to locate subsurface pipeline depth or pipelines located beneath an existing pipeline in line with one above another.

7. A method of interrogating a subsurface target, comprising:

deploying one or more sensors;

obtaining data from the one or more sensors;

converting the data from the one or more sensors to a one-dimensional vector via an adjoint operator;

processing the one-dimensional vector with a computer model to obtain a multidimensional (3D and 4D) image reconstruction of the target, wherein the resulting multidimensional (3D and 4D) image is suitable to identify areas of corrosion and wall weakness in a pipeline.

8. A method of interrogating a subsurface target, comprising:

deploying one or more sensors;

obtaining data from the one or more sensors;

converting the data from the one or more sensors to a one-dimensional vector via an adjoint operator;

processing the one-dimensional vector with a computer model to obtain a multidimensional (3D and 4D) image reconstruction of the target, wherein the resulting multidimensional (3D and 4D) image is used to detect and locate leaks and breaches in pipeline integrity.

9. A method of interrogating a subsurface target, comprising:

deploying one or more sensors to a location above the Earth's surface;

obtaining a plurality of data sets from the one or more sensors via one or more airborne devices, each comprising a drone, a helicopter, or an airplane, one or more ground borne vehicles, or one or more handheld devices or any combination thereof;

converting a first data set of the plurality of data sets to a first one-dimensional vector via an adjoint operator;

converting a second data set of the plurality of data sets to a second one-dimensional vector via an adjoint operator;

converting a third data set of the plurality of data sets to a third one-dimensional vector via an adjoint operator;

processing the first, second, and third one-dimensional vectors with a computer model to obtain a multidimensional (3D and 4D) image reconstruction of the target.

10. The method of claim 9, wherein the computer model includes machine learning algorithms for unstructured meshes.

11. The method of claim 9, wherein the target is a subsurface pipeline.

12. A method of interrogating a subsurface target, comprising:

deploying one or more sensors to a location above the Earth's surface;

obtaining a plurality of data sets from the one or more sensors;

converting a first data set of the plurality of data sets to a first one-dimensional vector via an adjoint operator;

converting a second data set of the plurality of data sets to a second one-dimensional vector via an adjoint operator;

converting a third data set of the plurality of data sets to a third one-dimensional vector via an adjoint operator;

processing the first, second, and third one-dimensional vectors with a computer model to obtain a multidimensional (3D and 4D) image reconstruction of the target, wherein the resulting multidimensional (3D and 4D) image is suitable to locate subsurface pipeline depth or pipelines located beneath an existing pipeline in line with one above another.

13. A method of interrogating a subsurface target, comprising:

deploying one or more sensors to a location above the Earth's surface;

obtaining a plurality of data sets from the one or more sensors;

converting a first data set of the plurality of data sets to a first one-dimensional vector via an adjoint operator;

converting a second data set of the plurality of data sets to a second one-dimensional vector via an adjoint operator;

converting a third data set of the plurality of data sets to a third one-dimensional vector via an adjoint operator;

processing the first, second, and third one-dimensional vectors with a computer model to obtain a multidimensional (3D and 4D) image reconstruction of the target, wherein the resulting multidimensional (3D and 4D) image is suitable to identify areas of corrosion and wall weakness in a pipeline.

14. A method of interrogating a subsurface target, comprising:

deploying one or more sensors to a location above the Earth's surface;

obtaining a plurality of data sets from the one or more sensors;

converting a first data set of the plurality of data sets to a first one-dimensional vector via an adjoint operator;

converting a second data set of the plurality of data sets to a second one-dimensional vector via an adjoint operator;

converting a third data set of the plurality of data sets to a third one-dimensional vector via an adjoint operator;

processing the first, second, and third one-dimensional vectors with a computer model to obtain a multidimensional (3D and 4D) image reconstruction of the target, wherein the resulting multidimensional (3D and 4D) image is used to detect and locate leaks and breaches in pipeline integrity.

15. A method of interrogating a subsurface pipeline, comprising:

deploying one or more sensors to a location above the Earth's surface;

obtaining a plurality of data sets from the one or more sensors via one or more airborne devices, each comprising a drone, a helicopter, or an airplane, one or more ground borne vehicles, or one or more handheld devices or any combination thereof;

converting a first data set of the plurality of data sets to a first one-dimensional vector via an adjoint operator;

converting a second data set of the plurality of data sets to a second one-dimensional vector via an adjoint operator;

converting a third data set of the plurality of data sets to a third one-dimensional vector via an adjoint operator;

processing the first, second, and third one-dimensional vectors with a computer model comprising machine learning algorithms for unstructured meshes to obtain a multidimensional (3D and 4D) image reconstruction of the pipeline, wherein the computer model is stored on a non-transitory memory that is configured to receive the data from the one or more sensors.

16. The method of claim 9, wherein the computer model is stored on a non-transitory memory that is configured to receive the data from the one or more sensors.

* * * * *